US008558143B2

(12) United States Patent
Segers

(10) Patent No.: US 8,558,143 B2
(45) Date of Patent: Oct. 15, 2013

(54) DOUBLE ARRANGEMENT OF DOMESTIC APPLIANCES

(75) Inventor: Hermann-Reinhard Segers, München (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1296 days.

(21) Appl. No.: 12/087,505

(22) PCT Filed: Dec. 11, 2006

(86) PCT No.: PCT/EP2006/069542

§ 371 (c)(1),
(2), (4) Date: Jul. 2, 2008

(87) PCT Pub. No.: WO2007/080036

PCT Pub. Date: Jul. 19, 2007

(65) Prior Publication Data

US 2009/0008375 A1 Jan. 8, 2009

(30) Foreign Application Priority Data

Jan. 10, 2006 (DE) ..... 10 2006 001 251

(51) Int. Cl.

| | |
|---|---|
| ***A21B 1/00*** | (2006.01) |
| ***A21B 3/00*** | (2006.01) |
| ***A21B 3/02*** | (2006.01) |
| ***F24C 7/08*** | (2006.01) |
| ***F24C 15/02*** | (2006.01) |
| ***F24C 15/06*** | (2006.01) |

(52) U.S. Cl.
USPC ..... 219/391; 219/394; 126/273 R; 126/190

(58) Field of Classification Search
USPC ..... 219/201; 34/595, 596
See application file for complete search history.

(56) References Cited

U.S. PATENT DOCUMENTS

| | | | | |
|---|---|---|---|---|
| 4,255,640 | A * | 3/1981 | Bressler | 219/704 |
| 5,806,942 | A * | 9/1998 | Jenkins et al. | 312/204 |
| 6,300,609 | B1 * | 10/2001 | Kim | 219/702 |
| 6,984,811 | B2 * | 1/2006 | Lee | 219/702 |
| 7,096,601 | B2 * | 8/2006 | Lyu et al. | 34/595 |
| 7,211,775 | B2 * | 5/2007 | Lee | 219/702 |
| 7,348,527 | B2 * | 3/2008 | Braunisch et al. | 219/757 |
| 7,373,737 | B2 * | 5/2008 | Lyu et al. | 34/595 |
| 7,383,644 | B2 * | 6/2008 | Lyu et al. | 34/596 |
| 7,645,966 | B2 * | 1/2010 | Hayakawa et al. | 219/756 |
| 2003/0168447 | A1 * | 9/2003 | Lee | 219/722 |

(Continued)

FOREIGN PATENT DOCUMENTS

| | | |
|---|---|---|
| CN | 2350648 Y | 11/1999 |
| DE | 197 37 524 | 3/1999 |

(Continued)

OTHER PUBLICATIONS

International Search Report PCT/EP2006/069542.

*Primary Examiner* — Joseph M Pelham
(74) *Attorney, Agent, or Firm* — James E. Howard; Andre Pallapies

(57) ABSTRACT

A group of domestic appliances mounted next to each other and substantially similarly oriented, each domestic appliance including a plurality of operator control elements, the group of domestic appliances comprising at least two domestic appliances and wherein the plurality of operator control elements is duplicated in the at least two of domestic appliances.

31 Claims, 7 Drawing Sheets

Fig. 1, 4

(56) References Cited

U.S. PATENT DOCUMENTS

| | | | | |
|---|---|---|---|---|
| 2005/0236387 | A1* | 10/2005 | Stockley | 219/394 |
| 2006/0225301 | A1* | 10/2006 | Lyu et al. | 34/595 |
| 2006/0225302 | A1* | 10/2006 | Lyu et al. | 34/595 |
| 2007/0102426 | A1* | 5/2007 | Braunisch et al. | 219/757 |
| 2007/0175885 | A1* | 8/2007 | Brower et al. | 219/401 |
| 2008/0134903 | A1* | 6/2008 | Kim et al. | 99/339 |
| 2009/0032010 | A1* | 2/2009 | Hoffmeier | 126/198 |
| 2009/0217920 | A1* | 9/2009 | Flesch et al. | 126/190 |
| 2010/0145483 | A1* | 6/2010 | Mcgonagle et al. | 700/83 |

FOREIGN PATENT DOCUMENTS

| | | |
|---|---|---|
| EP | 1 548 174 | 6/2005 |
| FR | 2 730 800 | 8/1996 |
| GB | 1 331 585 | 9/1973 |
| GB | 2 311 128 | 9/1997 |

* cited by examiner

DOUBLE ARRANGEMENT OF DOMESTIC APPLIANCES

The invention relates to an arrangement of domestic appliances mounted next to each other and identically oriented.

Domestic appliances are known, which are built into the same array of kitchen units and are identically oriented, typically with their front sides facing in the same direction. Up to now the disadvantage of this is that whilst the appliances are in fact oriented alongside each other, they are not mutually matched with regard to their operator control concept.

The object of the invention is to provide a means of improved operation of at least two domestic appliances mounted next to each other and identically oriented.

The object is achieved by the arrangement according to the exemplary embodiments described herein.

The arrangement has at least two domestic appliances mounted next to each other and identically oriented, each including a set of operator control elements, it being possible for the set of operator control elements to be identical in at least two of the domestic appliances. In other words, the same display and/or operator control elements, such as LCD displays, rotary switches, pushbuttons etc., are present on at least these domestic appliances. Obviously the assignment of the operator control elements can be adapted to the type of appliance, for example oven, refrigerator and so on. This certainly improves the clarity and thus the usability for the user. For the time being, the operator control elements can be arranged in any fashion on the respective appliance.

For further improvement of the user-friendliness it is favorable if the same set of operator control elements is identically positioned with respect to each other, that is to say the relative position of identical operator control elements with respect to each other is identical for the at least two domestic appliances. For example, in each set of these operator control elements the pushbuttons are then located at one side of a display panel, rotary switches are placed at another side, and so on. In this embodiment the orientation of the respective sets as such is still arbitrary in relation to the other sets, for example. One set can thus be offset by 90° with respect to the other one.

Moreover, it is favorable if the set of operator control elements of at least two of the domestic appliances has an identical axis of symmetry.

For rapid identification of the control panels and for a compact design, it is advantageous if the, in particular, two domestic appliances are mounted one above the other and the respective sets of operator control elements are arranged at opposite lateral areas of the domestic appliances. This results in a compact field of view for operation.

At the same time, it is also advantageous if the respective sets of operator control elements are arranged to be laterally centered with respect to each other.

The respective sets of operator control elements can then be arranged to be mirror-inverted with respect to each other, for example with reference to a line between the two domestic appliances.

However, the respective sets of operator control elements can also be arranged so as to be oriented in the same direction, which would correspond to a displacement (without rotation), for example.

For identical usability, it is also advantageous if the operator control elements as such are oriented in the same direction, for example with an upper zero position even with the mirror-inverted arrangement of the sets, that is to say the positioning of the operator control elements with respect to each other.

It is particularly advantageous if each set of identical operator control elements is at least partially, in particular completely, integrated in a control module.

The domestic appliances can, however, also be mounted alongside each other with the various relative arrangements of the sets and operator control elements, discussed above.

Advantageously, the control module has at least two operator control elements and can, at least partially, be inserted into a recess of a cooker door.

In this case a control module can be an enclosed subassembly or functional module that forms a part of a whole and which can be modified or replaced, without necessitating intervention or changes in the rest of the system (see Bibliographisches Institut & F. A. Brockhaus AG, Mannheim; Spektrum Akademischer Verlag GmbH, Heidelberg, 2003); this can favorably be a housing that is detachable from the door of the domestic appliance, with at least the operator control element or elements built into it.

With regard to distributed, individual operator control elements, this control module has the advantage that it requires fewer and simpler installation steps and can be more easily replaced. With regard to elements placed behind the front of the door there is the advantage of a possibly reduced installation height of the door itself, since the housing can project outwards; moreover, a greater variety of switching elements (knobs, toggle switches) is possible, which can also be easier to operate. With regard to control units mounted on the door, there is the advantage of a more reliable attachment, for example by clamping to the door, a less protruding form of construction and a simpler connection to other appliance components, for example a power supply.

Favorably, apart from operator control elements, that is to say switching elements (switches, knobs, pushbuttons, slider switches, etc.) and/or display elements (LED displays, alphanumeric displays such as LCD full-pixel panels, etc.), the control module can also have associated electrical and/or electronic equipment, as well as suitable communication means for data transmission with other components, for example cables, cable connections, evaluation and/or control electronics, wireless transmission devices or similar.

To reduce heat absorption from the door or from an internal space of the domestic appliance, for example a cooker, advantageously the respective control module has (from the standpoint of the domestic appliance) an outwardly projecting part which, after installation in the door, projects outwards from the surface of the door, as well as a part that can be inserted in the recess, which advantageously projects at the rear side of the part that can be inserted in the recess. As a result, the thickness or installation depth of the door can also be reduced and improved usability can be achieved.

Here it is favorable if the insertable part of the control module accepts in particular electrical and/or electronic components, while the outwardly projecting part contains the operator control elements. With such an arrangement it is possible to provide a large control panel, which can also project laterally (upwards, downwards, to the left and/or to the right in a plan view of the door) over the recess, while favorably the recess itself can be kept small in a thermally insulating manner.

For reasons of heat dissipation and improved usability, provision of a part of the control module projecting laterally over the recess or the part of the control module insertable in the recess (in the plan view of the door) can generally be advantageous.

For reasons of sealing the inner part of the door against the environment, it is advantageous if the part laterally projecting over the recess (that is to say at the left-hand side, right-hand side, upwards and/or downwards) can be mounted on a front door panel of the door of the domestic appliance, for example an exterior or front plate, in particular with a seal.

For additional sealing of a side edge of the appliance door, in particular having lateral open recesses, it is advantageous if the control module has a cover plate which is designed to cover at least one part, preferably the part opened by the recess, of a side edge of the door of the domestic appliance. In this case it is further favorable if there is a seal at the side edge of the appliance door in the region of the cover plate.

For simpler replacement and for improved attachment, it can be advantageous for example if the cover plate projects in the lateral direction over the region of the side edge (top, bottom, left-hand and/or right-hand) bordering it.

This applies in particular to doors which cover one side of the domestic appliance without the use of a control panel. Optimization of the thermal insulation is especially favorable for doors with fully-glazed surface, possibly with the exception of a narrow frame.

For the functional optimization of the control module it is favorable if the predominant number of the operator control elements, in particular all operator control elements, are housed in a single control module. It then requires only a single recess in the door and thus only one insertion and attachment operation. A repair is also made easier by replacement of the entire control module.

For simpler operation it is advantageous if the control module has at least one display panel, for example a pixel-driven LCD display, as well as at least one rotary switch or knob. In this case it is especially favorable if the at least one rotary switch is arranged below the display panel.

For improved, in particular simpler and more intuitive user prompting it is favorable if buttons are mounted at the side of the display panel, in particular if the buttons are mounted at the left-hand side and/or the right-hand side of the display panel, in particular if the buttons are mounted symmetrically at the left-hand side and to the right-hand side of the display panel.

It is also advantageous if the buttons are pushbuttons, as they can then in particular form a surface plane with the display panel.

For example, for improved user-friendliness and for easier cleaning, it is advantageous if the buttons and the display panel are covered by a common cover, in particular a common plate, for example a plastic plate.

A control module in which the display panel and/or the buttons are mounted in the region of the outwardly projecting part opposite the part insertable in the recess, is particularly advantageous since an electronic control and evaluation unit can then be mounted close to these operator control elements, in particular the display panel.

It is also advantageous if the at least one rotary switch is arranged at the part projecting laterally over the recess and, in particular, attachable to the door panel, since the size and position of the rotary switch is not then restricted by the recess and the recess can be kept small. This particularly applies since an associated electronic evaluation unit is not required for the rotary switch, and compared to the electronic control unit for the display, can be simple and small.

In order to prevent users catching themselves on an edge of the control module, it is favorable if the outwardly projecting part is at least partially beveled at one edge region, typically from the front surface rearwards, for example toward the front door panel. In order to maintain a large packing density for the control module it is favorable if, in particular, the part projecting laterally over the recess is beveled, especially toward the door panel. Favorably in this case the part projecting laterally over the recess can be beveled in one or more directions (for example to the left-hand side, right-hand side and/or upwards or downwards. It is particularly advantageous if the control module is beveled, for example chamfered, at a side facing away from the edge of the door of the domestic appliance. The operator control elements, for example rotary switches, can also be mounted in an area that is partially beveled and partially not beveled.

For simple usability it is advantageous if the switches are arranged in pairs symmetrically about the central axis of the control device. The central axis can be perpendicular to the edge of the appliance door and be, in particular, a vertical central axis.

For secure attachment, the control module (2, 33) has at least one mounting element, in particular a thread to accept a screw, in a rear area, in particular in the part to be inserted into the recess.

The object is also achieved by a domestic appliance door, in particular a cooker door, especially an oven door, having at least one recess for accepting in each case at least one of the control modules described above, into which recess a control module can be inserted. In particular, the door can be a door for cookers, in particular for ovens.

It is advantageous if the control module is partially inserted into the door recess and partially projects outwards. Favorably, the insertable part of the control module accepts in particular electrical and/or electronic components, whereas the outwardly projecting part contains in particular the operator control elements.

The recess can be fitted into the door of the domestic appliance at different depths according to requirements. In order to minimize the effect of a recess on an appliance door, only the front door panel, that is to say the front plate, needs to be provided with the recess. Dependent on the requirement, for example the internal construction of the door, the arrangement of the control module or cooling requirements, the recess can also be made through other door elements, for example other door plates, partitions or insulating areas. In this case it is also possible for the recess to pass through the entire appliance door, so that the control module with its part that is insertable in the recess can be passed right through the door.

The recess can for example include or represent a laterally open cut-out in at least the front door panel; this is advantageous for simpler mounting. Alternately, the recess can be enclosed on all sides by material of least that of the front panel. The recess can also be laterally open on two sides. It is also possible for the recess to be differently formed in different positions in the door, for example as a laterally open recess in the front plate and as an enclosed recess in a plate lying behind it.

The outwardly projecting part can also protrude in any direction (that is to say to the left, to the right, up and/or down) over the part to be inserted into the recess.

It can also be favorable if the door has a complete glass front in which the recess is placed. It is favorable in the case of a complete glass door in particular if the door handle is integrated into the side of the door.

The object is also achieved by a domestic appliance, in particular a cooker that has a door as described above having at least one control module suitable for the use described above. This applies in particular to domestic appliances without a separate control panel.

The invention is described in the following figures by means of schematic exemplary embodiments. These exemplary embodiments do not limit the invention, which is determined by the scope of the claims. Identical parts are generally identified by identical reference numbers.

Figure 1:
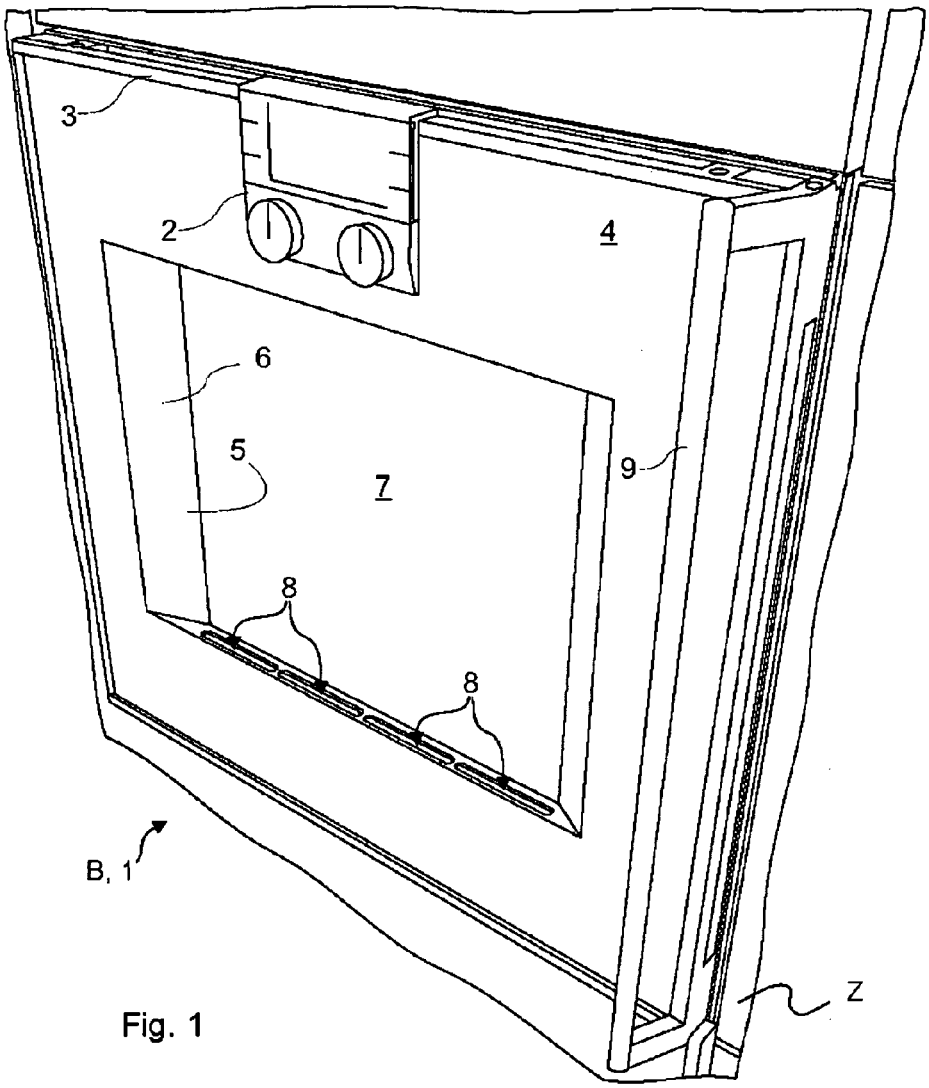
FIG. 1 shows in sketch form an external oblique view of a built-in oven with control module.

FIG. 1 shows an oven door 1 of an oven B into which a control module 2 is installed, said oven being built into an array of kitchen units Z. The oven door 1 completely covers the front side of the oven, so that this does not require a separate control panel. At its outer side or front side the oven door 1 has an all-over external glass plate 4 as the front door panel, retained only by a narrow metal frame 3. Furthermore, for thermal insulation the oven door 1 has an inner glass plate 5, thereby forming an inner space in the door between the plates 4, 5. There can be further glass plates parallel to these. A masking frame 6, which among other things is used as an optical screen and for conducting the air-flow, is installed in this inner space in the door. A viewing window is defined by a cut-out 7 in the masking frame 6. Ventilation slots 8 for supplying fresh air are inserted in the lower part of the masking frame 6. Here the upper exhaust slots are not shown. The oven door 1 can be opened and closed sideways by means of the handle 9.

The control module 2 projects forwards and upwards from the outer glass panel 4. Its front side lies partially parallel to the surface of the outer glass plate 4, but is beveled in the lower edge region to the outer glass plate 4. The projecting sides of the control module 2 are not beveled any more than the upwards projecting part.

Figure 2:
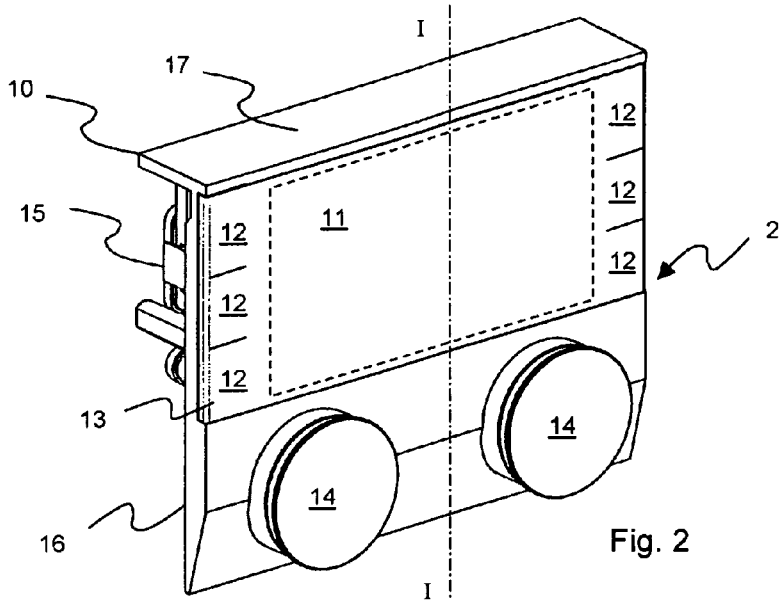
FIG. 2 shows an oblique view of the front side of the control module of FIG. 1.

FIG. 2 shows an oblique front view of the control module 2 of FIG. 1 in more detail. In a common housing 10, the control module 2 contains a display unit in the form of a pixel-driven LCD display 11; three touch-sensitive buttons 12 are installed at the left-hand side and the right-hand side, respectively. The LCD display 11 and the buttons 12 are covered by a common plastic plate 13. As additional switches, two rotary knobs 14 are located at the sides below the LCD display 11. Here the knobs 14 are also located at the sides below an area 15 to be installed in the recess on a part 16 projecting externally from the appliance door 1. The part 16 projecting externally from the appliance door 1 is partially beveled toward the bottom; the knobs 14 are partially located in the beveled area and partially in the non-beveled area. At the upper edge the control module 2 has a cover plate 17, which can cover an edge of an appliance door and here also borders one edge of the plastic plate.

The display 11, the buttons 12 and the knobs 14 are symmetrically arranged with respect to a vertical center line I-I.

Figure 3:
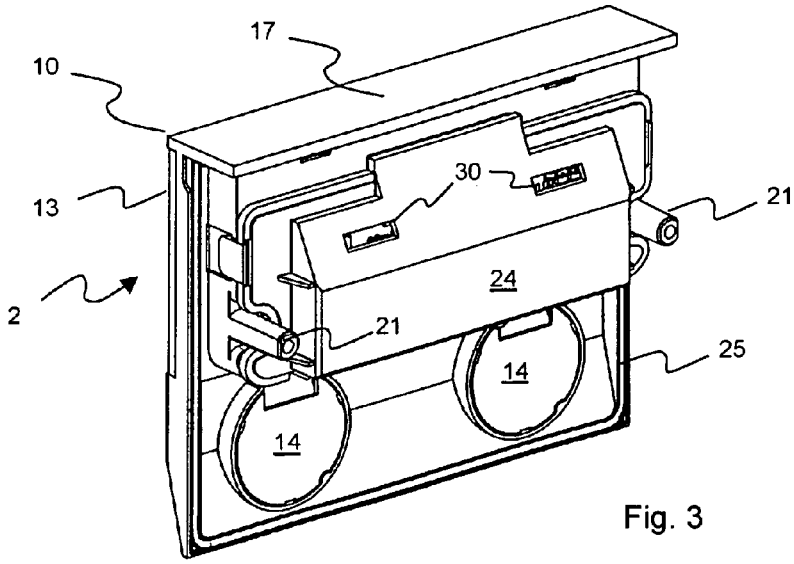
FIG. 3 shows an oblique view of the rear side of the control module of FIGS. 1 and 2.

FIG. 3 shows an oblique rear view of the control module 2 of FIGS. 1 and 2. Here the part 15 to be fitted in the recess shows electrical connections 30 as an electronic receptacle area 24. A seal 25 running around the rear edge area can be clearly seen. In the area of the rotary knobs 14 the seal 25 contacts the front door panel and seals the interior of the door and the control module 2 against the environment. In the upper, rear edge area, that is here covered by the upper cover plate 17, the seal 25 runs for a short distance underneath the cover plate 17, as is also shown below in FIG. 5. It can be seen that the plastic plate 13 is approximately located in front of the part 15 that can be inserted in the recess.

For attachment to the appliance door 1, the control module 2 has, among other things, two threads 21 integrally bonded to the housing 10, into which the fixing screws (not shown) or similar can be screwed.

Figure 4:
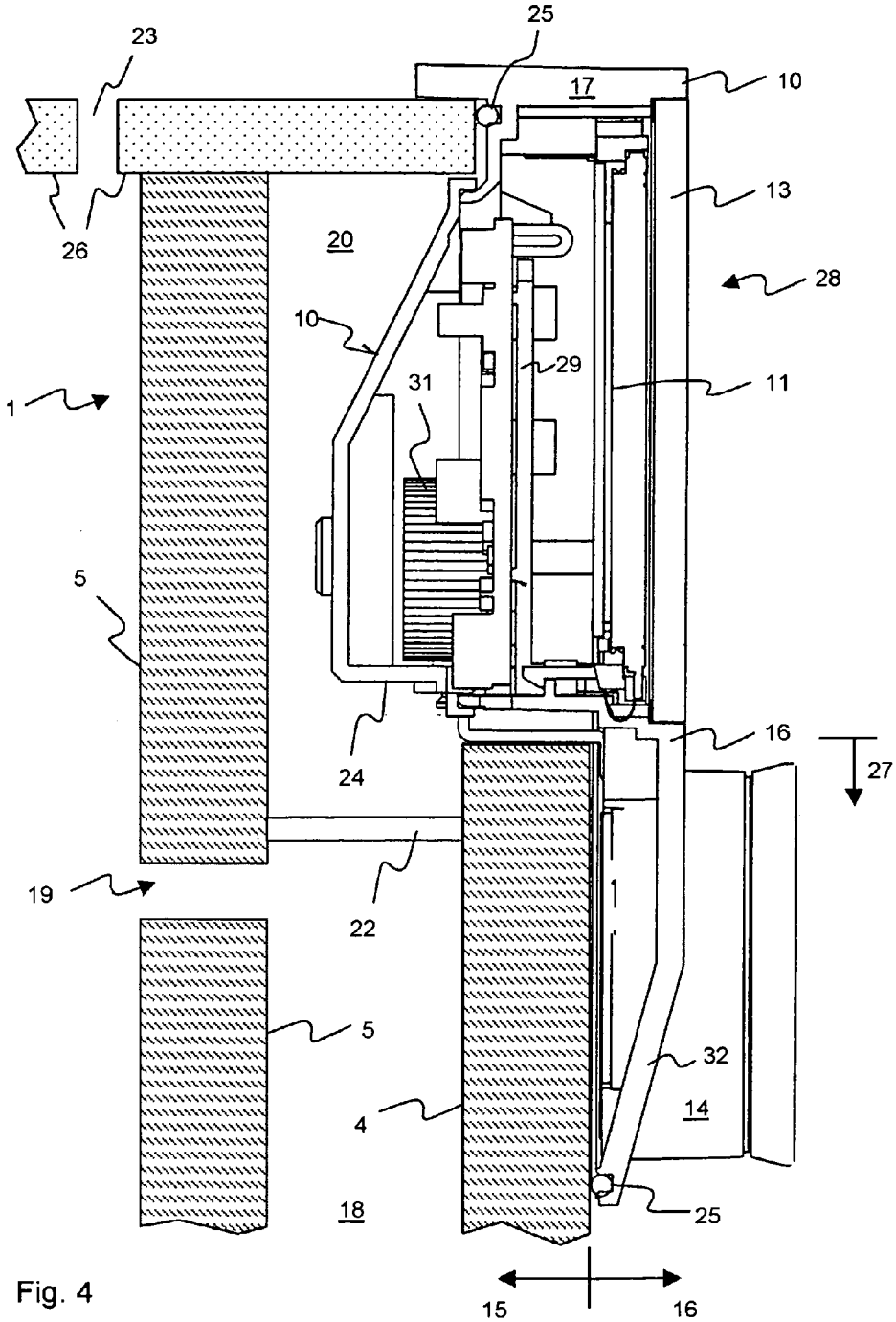
FIG. 4 shows a side sectional view of the control module of FIGS. 1 to 3.

FIG. 4 shows a lateral sectional view of the control module 2 of FIGS. 1 to 3 along the line I-I in FIG. 2, built into an appliance door 1. The projecting area 16, as denoted by the arrow pointing to the right, as well as the part 15 which can be inserted in a recess 28 of the outer plate 4, as denoted by the arrow pointing to the left, can be seen. The projecting part 16 contains the operator control elements such as the knobs 14, the LCD display 11 installed behind a protective plastic plate 13, as well as the touch-sensitive buttons (not shown), all of which are accommodated in a common housing 10. The part 15 that can be inserted into the recess 28 includes an electronic unit 29 for evaluating the signals of the operator control element 14; at that point there is also a loudspeaker 31 driven by the electronic unit 29, for example to generate click noises when the knob 14 is rotated.

It can be easily seen that the part 27 belonging to the outwardly projecting part 16 of the control module 2, and projecting laterally downwards over the recess 28 and denoted by the associated arrow, makes contact with the outer plate 4 via the seal 25. The rotary switches 14 therefore likewise make contact with the outer front door plate, or possibly with a small clearance. The part 27 projecting over the recess 28 shows the bevel 32 to the outer front plate 4. The rotary switches 14 are arranged partially in the surface parallel to the front glass plate 4 and partially in the beveled part 32.

It can also be seen that the upper cover plate 17 covers a part of the side edge of the cooking appliance door 1 and also seals it by means of the seal 25. The cover plate 17 extends upwards over the delimiting upper lateral edge of the cooking appliance door 1, which in this section is formed by an edge seal 26.

The recess 28 into which the control module 2 is inserted is placed only in the outer glass plate 4; a second glass plate 5 located behind it has no recess to accept the control module 2. Here the recess 28 is a laterally upwards opening recess.

The control module receiving space 20 which is closed by the control module 2, is defined by the outer glass plate 4, the second, inner glass plate 5, the edge seal 26 and the partition 22 that is provided for thermal decoupling of the lower area of the inner space 18 of the door. The housing part 24 for the electronic unit with the electronics 29, which can be inserted into the recess 28, is located in the control module receiving space 20.

The door ventilation opening 19, through which the hot air from the area opposite the cooking chamber can escape, is provided for further thermal decoupling of the control module receiving space 20 and inner space 18 of the door. Furthermore, the ventilation opening 23, by which the rear side of the control module receiving space 20 is cooled, is provided in the edge seal.

Figure 5:
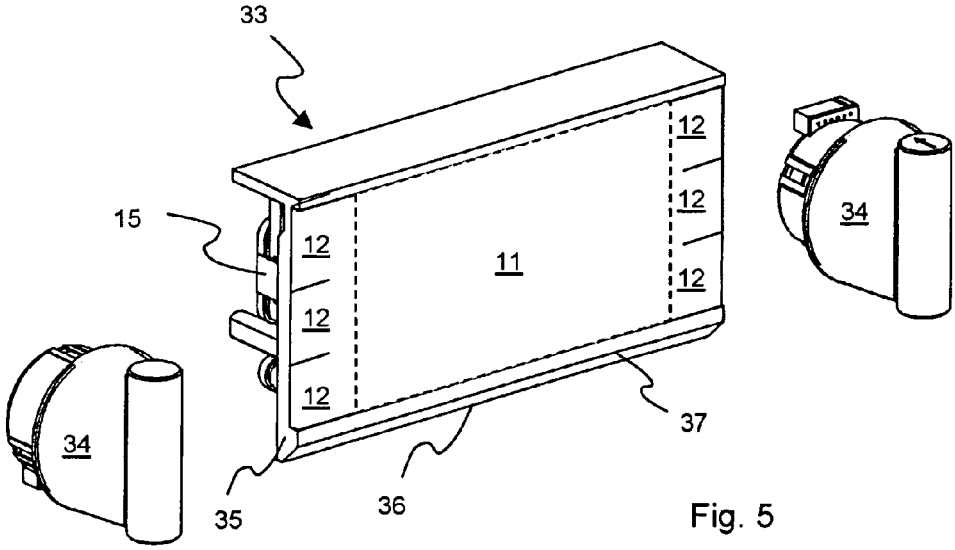
FIG. 5 shows an oblique view of the front side of an operator control element.

FIG. 5 shows a further control module 33 having a display unit 11 and touch-sensitive buttons 12, said control module, however, now having separate knobs 34. The lower edge 35 of this control module 33 is an outwardly projecting part 36 and also projects laterally downwards over the insertable part 15, so that here again display 11 and buttons 12 are arranged in front of the outer front panel of a door. Likewise, the lower edge has a beveled part 37.

Alternately, the rotary switches 14 can also be laterally integrated into the control module 33, that is to say accommodated in the housing. For example, the left-hand side and the right-hand side of the part projecting laterally over the recess can then each receive a rotary switch and also be beveled, for example downwards and/or to the left-hand side or to the right-hand side, respectively.

In a further embodiment, for example, the cover plate can be mounted below and the control module can be beveled upwards, in particular when mounted on a lower side of the door.

Figure 6:
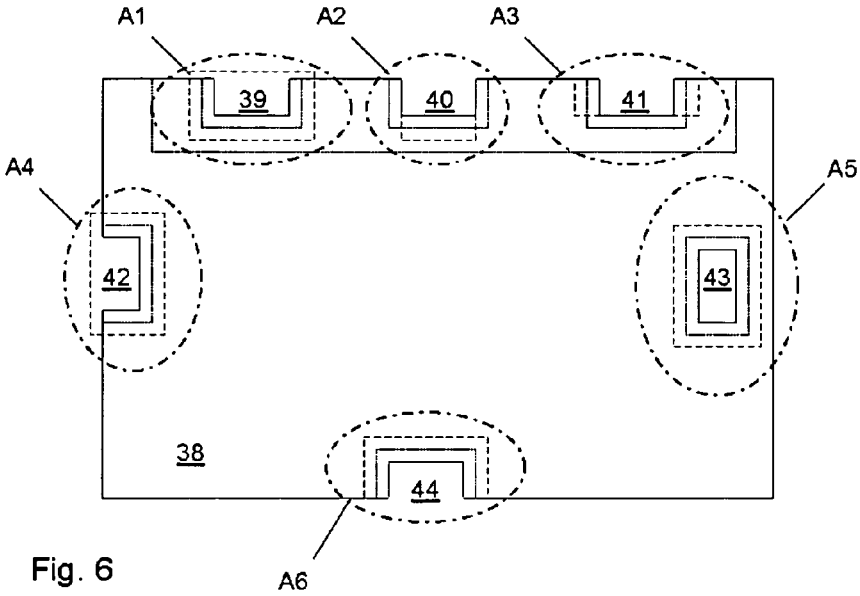
FIG. 6 shows a schematic, plan view of the front side with several possibilities for the layout of the oven door.

FIG. 6 shows in sketch form a front plan view of a front door panel 38 with five selected examples of the arrangement of recesses 39 to 44, which are marked by the dash-dotted areas A1 to A6. In a definite embodiment, the areas A1 to A6 can exist individually, in multiples or in combination, and in fact at any suitable locations on an oven door. In the following, each of the thermally limiting partitions, for example the strips, ribs, insulating walls etc. in the inner space of the door, here defining the position of the control module receiving space 20, are shown by dotted lines, whereas the outer limit of the control module at the outside of the front door panel 38 is shown by the dashed line.

In the area A1 the recess 39 opens upwards in the outer front plate 4, so that the module can be inserted from above, for example. In this case it can also project upwards. The associated thermal boundary in the inner space of the door,—shown by the dotted line—encloses the recess except for the upper cut-out and thus also defines the control module receiving space 20. Here the outwardly projecting part of the control module projects to the left and to the right, as well as downwards over the thermal boundary or the control module receiving area, and also upwards if required.

If better thermal screening is desired, the control module receiving area can be made so large that the projecting part of the control module projects for example in the lateral direction (to the left, to the right, up and/or down), that is to say over the recess, but not over the control module receiving area, for example.

In the area A2 the projecting part of the control module projects only downwards over the recess and the control module receiving area, and only laterally in the area A3.

Area A4 shows a functional construction analogous to area A1, but now laterally to the left in the door panel 38. In this case the control module can also project laterally over the edge of the front door panel 38.

Area A5 differs from areas A1 to A4 in that the recess 43 is totally enclosed by the outer plate 38; here the projecting part of the control module projects laterally in all directions over the recess and the control module receiving area.

In construction, area A6 corresponds to areas A1 and A4, the recess 47 is arranged so that it opens toward the bottom side of the door 38, and the cover plate is therefore favorably arranged at the bottom side of the control module.

Also shown is that several recesses (in this case areas A1 to A3) are separated from the hot area of the door 38 by a common thermal boundary or division.

The invention is not limited to the above constructional features. In fact, use with hot/cold doors is particularly advantageous; the invention can, however, be applied to all domestic appliances fitted with a door.

For example, the door can be fitted with other panels made of metal, plastic, etc. for example. These panels must also not be transparent. Materials other than glass can also be used for transparent plates.

Moreover, the ventilation does not need to have the form shown in the exemplary embodiments; for example, the air can be routed the other way round in the cooker, ventilation inlet and outlet openings can be positioned differently, and so on. Ventilation can also be completely dispensed with; the door can then manage without a hollow inner space.

Furthermore, several modules can be accommodated in one recess and alternately or additionally, several recesses can each be used with one control module.

Figure 7:
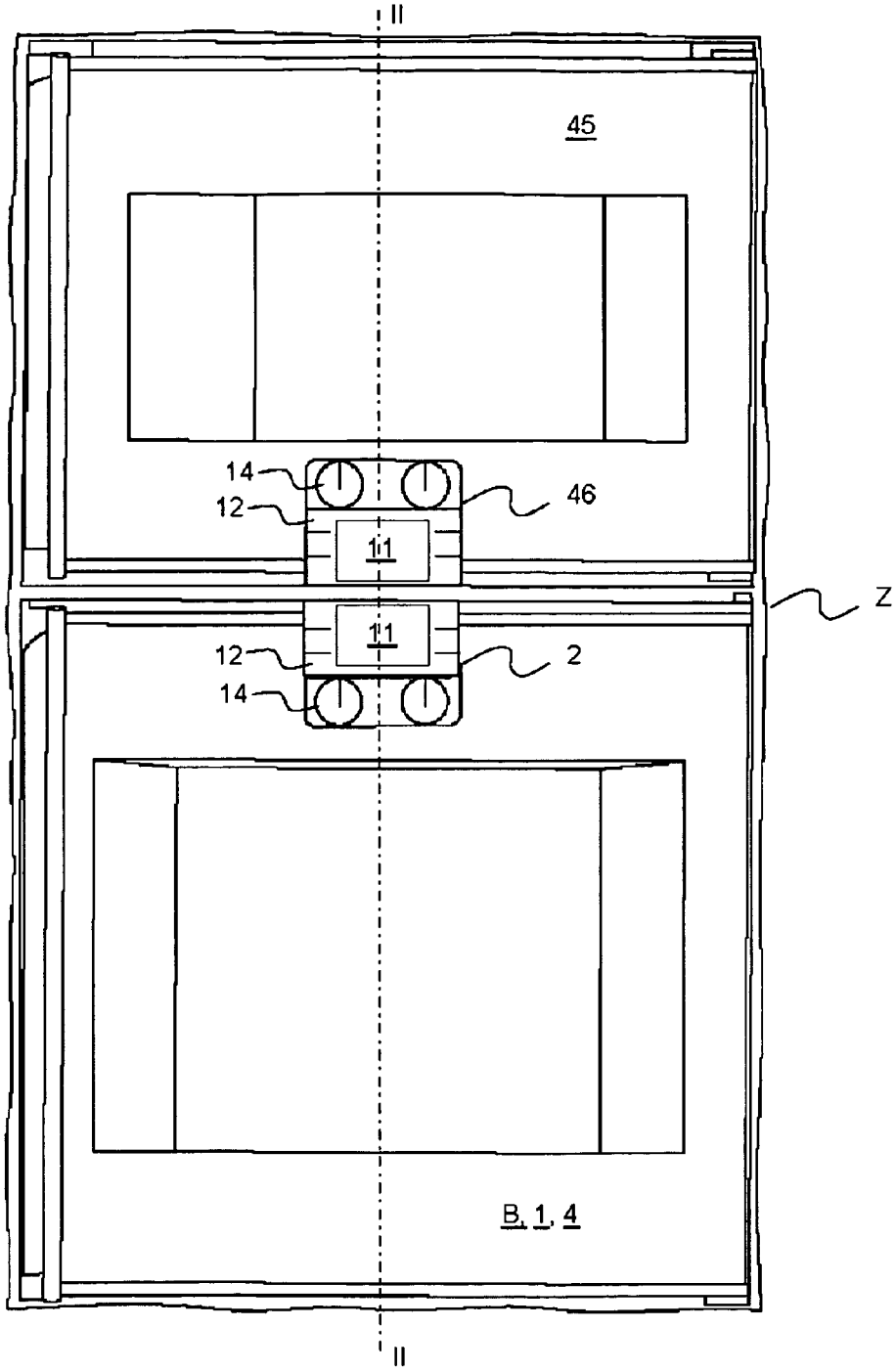
FIG. 7 shows an arrangement of two domestic appliances placed one above the other.

FIG. 7 shows a front view of two ovens 1, 45 built into the array of kitchen units Z, one above the other. The bottom oven corresponds to the cooking appliance 1 in FIG. 1, with the corresponding components. A steam oven 45 is placed above this.

Each of the two ovens B, 45 has operator control elements in the form of a display 11, three buttons 12 arranged at the side of the display 11, as well as click-stop rotary switches 14. As FIGS. 2 to 6 show, the operator control elements 11,12,14 of the lower oven B are integrated in the control module 2.

The upper oven 45 likewise has the same operator control elements 11,12,14, which are likewise integrated in a control module 46.

The control modules 2,46, and with them the operator control elements 11,12,14 have the same axis of symmetry II-II. They are thus arranged on opposite lateral areas of the domestic appliances B, 45. The cover plates of the respective control module cover a corresponding opposite edge and face each other.

In the control modules the operator control elements have identical positions relative to each other; by rotation and displacement, operator control elements of control module 2 could therefore be positioned as functionally identical operator control elements of control module 46.

Moreover, the operator control elements of the respective control modules B,46 are arranged so that the operator control elements are mirror-inverted with respect to each other, in this case by placing the display panel 11 and the buttons toward the edge, and the rotary switches toward the center of the respective oven B, 45.

Figure 8:
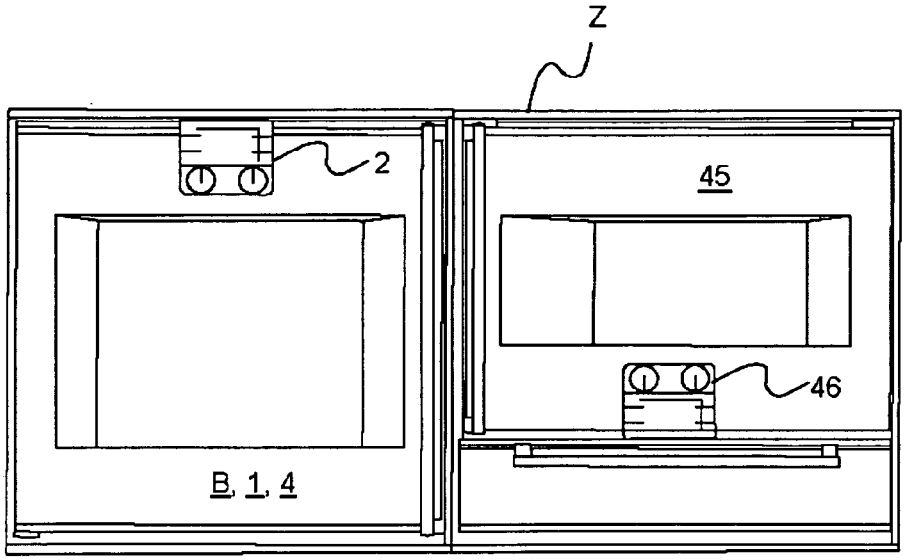
FIG. 8 shows an arrangement of two domestic appliances mounted next to each other.

FIG. 8 shows the two ovens B,46 of FIG. 7 arranged next to each other.

LIST OF REFERENCE NUMBERS

1 Oven door
2 Control module
3 Metal frame
4 Outer glass plate
5 Inner glass plate
6 Masking frame
7 Cut-out
8 Ventilation slots
9 Handle
10 Housing
11 LCD display
12 Touch-sensitive buttons
13 Protective plastic plate
14 Knob
15 Part of the control module which can be inserted in a recess
16 Outwardly projecting part of the control module
17 Cover plate
18 Inner space of door
19 Door ventilation opening

20 Control module receiving area
21 Housing thread
22 Partition
23 Ventilation opening
24 Receiving area for electronic unit
25 Seal
26 Edge seal
27 Supporting part
28 Recess
29 Electronic unit
30 Electrical connections
31 Loudspeaker
32 Beveled part
33 Control module
34 Knob
35 Bottom edge
36 Outwardly projecting part of the control module
37 Beveled part
38 Front door panel
39 Recess
40 Recess
41 Recess
42 Recess
43 Recess
44 Recess
45 Domestic appliance
46 Control module
A1-A6 Control module areas
B Oven

The invention claimed is:

1. A group of domestic appliances mounted next to each other and substantially similarly oriented, each domestic appliance including a door having a plurality of operator control elements, the group of domestic appliances comprising at least two domestic appliances and wherein the plurality of operator control elements is duplicated in the at least two of domestic appliances, and wherein the plurality of operator control elements are arranged on each door of the domestic appliances such that a first set of the plurality of operator control elements is mutually matched with a second set of the plurality of operator control elements, wherein the first set being mutually matched with the second set includes the first set being one of symmetrically arranged, adjacently arranged, and arranged in a minor image with respect to the second set, wherein the domestic appliances are mounted laterally next to each other, wherein the respective sets of operator control elements are arranged only on adjacent lateral areas of each door, and wherein the respective sets of operator control elements are vertically centered with respect to a height of each door.

2. The group according to claim 1 wherein at least two substantially similar sets of operator control elements are substantially similarly positioned with respect to each other.

3. The group according to claim 1 wherein at least two sets of operator control elements include substantially similar axes of symmetry associated with at least two of the domestic appliances.

4. The group according to claim 1, wherein each domestic appliance includes a control module, and wherein the sets of substantially similar operator control elements are integrated at least partially in each control module.

5. The group of claim 1, wherein the respective sets of operator control elements are arranged to be minor images of one another.

6. A group of domestic appliances mounted next to each other and substantially similarly oriented, each domestic appliance including a door having a plurality of operator control elements, the group of domestic appliances comprising at least two domestic appliances and wherein the plurality of operator control elements is duplicated in the at least two of domestic appliances, and wherein the plurality of operator control elements are arranged on each door of the domestic appliances such that a first set of the plurality of operator control elements is mutually matched with a second set of the plurality of operator control elements, wherein the first set being mutually matched with the second set includes the first set being one of symmetrically arranged, adjacently arranged, and arranged in a minor image with respect to the second set, wherein the domestic appliances are mounted one above the other and the respective sets of operator control elements are arranged on opposite lateral areas of each door of the domestic appliances.

7. The group according to claim 6 wherein the respective sets of operator control elements are arranged to be laterally centered with respect to each door.

8. The group according to claim 6 wherein the respective sets of operator control elements are arranged to be minor images of one another.

9. The group according to claim 6 wherein the respective sets of operator control elements are arranged so as to be oriented in a same direction.

10. The group according to claim 9 wherein the operator control elements are arranged so as to be oriented in a same direction.

11. A system of domestic appliances, the system comprising:

a first domestic appliance having a first front panel, a first opening in the first front panel, and a first door movable to access the first opening;

a second domestic appliance having a second front panel, a second opening in the second front panel, and a second door movable to access the second opening;

the second domestic appliance mounted next to the first domestic appliance and substantially similarly oriented to the first domestic appliance;

the first domestic appliance having a plurality of first operator control elements on the first door, the second domestic appliance having a plurality of second operator control elements on the second door, wherein the plurality of first operator control elements has a same configuration as a configuration of the plurality of second operator control elements, and wherein the plurality of first operator control elements is mutually matched with the plurality of second operator control elements, wherein the plurality of first operator control elements being mutually matched with the plurality of second operator control elements includes the plurality of first operator control elements being one of symmetrically arranged, adjacently arranged, and arranged in a minor image with respect to the plurality of second operator control elements, wherein the first domestic appliance is arranged laterally next to the second domestic appliance, wherein the plurality of first operator control elements on the first door and the plurality of second operator control elements on the second door are arranged alongside each other on adjacent lateral areas of the first door and the second door, and wherein the plurality of first operator control elements is vertically centered with respect to a height of the first door and the plurality of second operator control elements is vertically centered with respect to a height of the second door.

12. The system according to claim 11, wherein a position of the plurality of first operator control elements on the first door is substantially similar to a position of the plurality of second operator control elements on the second door.

13. The system according to claim 11, wherein the plurality of first operator control elements on the first door and the plurality of second operator control elements on the second door have substantially similar axes of symmetry with respect to the first door and the second door.

14. The system according to claim 11, wherein the plurality of first operator control elements on the first door are arranged in a same direction as the plurality of second operator control elements on the second door.

15. The system according to claim 11, wherein each operator control element of the plurality of first operator control elements on the first door is arranged in a same direction as each operator control element of the plurality of second operator control elements on the second door.

16. The system according to claim 11, wherein the first door includes a first control module, the first control module including at least a portion of the plurality of first operator control elements, and wherein the second door includes a second control module, the second control module including at least a portion of the plurality of second operator control elements.

17. The system according to claim 16, wherein the first door includes a first recess, and the first control module is mounted in the first recess.

18. The system according to claim 17, wherein the second door includes a second recess, and the second control module is mounted in the second recess.

19. The system according to claim 11, wherein one of the first domestic appliance and the second domestic appliance is an oven.

20. The system according to claim 11, wherein the first door opens sideways with respect to the first appliance.

21. The system according to claim 20, wherein the second door opens sideways with respect to the second appliance.

22. The system according to claim 11, wherein the first door completely covers a front of the first appliance.

23. The system according to claim 22, wherein the second door completely covers a front of the second appliance.

24. The system of claim 11, wherein the plurality of first operator control elements on the first door are arranged in a minor image to the plurality of second operator control elements on the second door.

25. The system of claim 11, wherein the plurality of first operator control elements on the first door are arranged in a minor image to the plurality of second operator control elements on the second door with respect to a dividing line between the adjacent areas of the first door and the second door.

26. The system of claim 11, wherein the plurality of first operator control elements and the plurality of second operator control elements are arranged so as to be oriented in a same direction.

27. A system of domestic appliances, the system comprising:

a first domestic appliance having a first front panel, a first opening in the first front panel, and a first door movable to access the first opening;

a second domestic appliance having a second front panel, a second opening in the second front panel, and a second door movable to access the second opening;

the second domestic appliance mounted next to the first domestic appliance and substantially similarly oriented to the first domestic appliance;

the first domestic appliance having a plurality of first operator control elements on the first door, the second domestic appliance having a plurality of second operator control elements on the second door, wherein the plurality of first operator control elements has a same configuration as a configuration of the plurality of second operator control elements, wherein the plurality of first operator control elements is mutually matched with the plurality of second operator control elements, wherein the plurality of first operator control elements being mutually matched with the plurality of second operator control elements includes the plurality of first operator control elements being one of symmetrically arranged, adjacently arranged, and arranged in a minor image with respect to the plurality of second operator control elements, wherein the plurality of first operator control elements are centered with respect to a width of the first door, and wherein the plurality of second operator control elements are centered with respect to a width of the second door.

28. A system of domestic appliances, the system comprising:

a first domestic appliance having a first front panel, a first opening in the first front panel, and a first door movable to access the first opening;

a second domestic appliance having a second front panel, a second opening in the second front panel, and a second door movable to access the second opening;

the second domestic appliance mounted next to the first domestic appliance and substantially similarly oriented to the first domestic appliance;

the first domestic appliance having a plurality of first operator control elements on the first door, the second domestic appliance having a plurality of second operator control elements on the second door, wherein the plurality of first operator control elements has a same configuration as a configuration of the plurality of second operator control elements, wherein the plurality of first operator control elements is mutually matched with the plurality of second operator control elements, wherein the plurality of first operator control elements being mutually matched with the plurality of second operator control elements includes the plurality of first operator control elements being one of symmetrically arranged, adjacently arranged, and arranged in a minor image with respect to the plurality of second operator control elements, wherein the first domestic appliance is arranged on top of the second domestic appliance, wherein the plurality of first operator control elements on the first door are arranged above the plurality of second operator control elements on the second door and on adjacent areas of the first door and the second door, wherein the plurality of first operator control elements are centered with respect to a width of the first door, and wherein the plurality of second operator control elements are centered with respect to a width of the second door.

29. The system according to claim 28, wherein the plurality of first operator control elements on the first door are arranged in a minor image to the plurality of second operator control elements on the second door with respect to a dividing line between the adjacent areas of the first door and the second door.

30. A system of domestic appliances, the system comprising:

a first domestic appliance having a first front panel, a first opening in the first front panel, and a first door movable to access the first opening;

a second domestic appliance having a second front panel, a second opening in the second front panel, and a second door movable to access the second opening;

the second domestic appliance mounted next to the first domestic appliance and substantially similarly oriented to the first domestic appliance;

the first domestic appliance having a plurality of first operator control elements on the first door, the second domestic appliance having a plurality of second operator control elements on the second door, wherein the plurality of first operator control elements has a same configuration as a configuration of the plurality of second operator control elements, wherein the plurality of first operator control elements is mutually matched with the plurality of second operator control elements, wherein the plurality of first operator control elements being mutually matched with the plurality of second operator control elements includes the plurality of first operator control elements being one of symmetrically arranged, adjacently arranged, and arranged in a minor image with respect to the plurality of second operator control elements, and wherein the plurality of first operator control elements on the first door are arranged in a minor image to the plurality of second operator control elements on the second door.

31. A system of domestic appliances, the system comprising:

a first domestic appliance having a first front panel, a first opening in the first front panel, and a first door movable to access the first opening;

a second domestic appliance having a second front panel, a second opening in the second front panel, and a second door movable to access the second opening;

the second domestic appliance mounted next to the first domestic appliance and substantially similarly oriented to the first domestic appliance;

the first domestic appliance having a plurality of first operator control elements on the first door, the second domestic appliance having a plurality of second operator control elements on the second door, wherein the plurality of first operator control elements has a same configuration as a configuration of the plurality of second operator control elements, wherein the plurality of first operator control elements is mutually matched with the plurality of second operator control elements, wherein the plurality of first operator control elements being mutually matched with the plurality of second operator control elements includes the plurality of first operator control elements being one of symmetrically arranged, adjacently arranged, and arranged in a minor image with respect to the plurality of second operator control elements, wherein the first domestic appliance is arranged on top of the second domestic appliance, wherein the plurality of first operator control elements on the first door are arranged above the plurality of second operator control elements on the second door and on adjacent areas of the first door and the second door, and wherein the plurality of first operator control elements on the first door are arranged in a minor image to the plurality of second operator control elements on the second door with respect to a dividing line between the adjacent areas of the first door and the second door.

* * * * *

UNITED STATES PATENT AND TRADEMARK OFFICE

CERTIFICATE OF CORRECTION

PATENT NO. : 8,558,143 B2
APPLICATION NO. : 12/087505
DATED : October 15, 2013
INVENTOR(S) : Hermann-Reinhard Segers It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1423 days.

Signed and Sealed this
Fifteenth Day of September, 2015

Michelle K. Lee

Michelle K. Lee
*Director of the United States Patent and Trademark Office*